US007799177B2

(12) United States Patent
Oder et al.

(10) Patent No.: US 7,799,177 B2
(45) Date of Patent: Sep. 21, 2010

(54) VALVE INSTALLATION APPARATUS AND METHODS

(75) Inventors: John W. Oder, Houston, TX (US); Leslie P. Antalffy, Houston, TX (US); Samuel A. Martin, Sugarland, TX (US); Kenneth D. Kirkpatrick, Sugarland, TX (US); Michael B. Knowles, Missouri City, TX (US); George T. West, Houston, TX (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 755 days.

(21) Appl. No.: 10/591,936

(22) PCT Filed: Mar. 17, 2004

(86) PCT No.: PCT/US2004/008350

§ 371 (c)(1),
(2), (4) Date: Jun. 27, 2007

(87) PCT Pub. No.: WO2005/095546

PCT Pub. Date: Oct. 13, 2005

(65) Prior Publication Data

US 2007/0261949 A1 Nov. 15, 2007

(51) Int. Cl.
*C10B 33/00* (2006.01)
*B21K 1/24* (2006.01)

(52) U.S. Cl. ..... 201/41; 202/242; 202/245; 29/888.44; 29/592

(58) Field of Classification Search ..... 201/41; 202/242, 245; 414/216; 29/888.44, 592
See application file for complete search history.

(56) References Cited

U.S. PATENT DOCUMENTS

| | | | | |
|---|---|---|---|---|
| 5,098,524 | A * | 3/1992 | Antalfy et al. | 202/96 |
| 5,581,864 | A | 12/1996 | Rabet | 29/426.3 |
| 5,785,843 | A | 7/1998 | Antalffy et al. | 208/131 |
| 5,947,674 | A * | 9/1999 | Malsbury et al. | 414/216 |
| 6,039,844 | A * | 3/2000 | Malik | 202/227 |
| 6,228,225 | B1 * | 5/2001 | Meher-Homji | 202/250 |
| 6,264,829 | B1 | 7/2001 | Antalffy et al. | 208/131 |
| 6,565,714 | B2 * | 5/2003 | Lah | 202/245 |
| 6,808,602 | B2 * | 10/2004 | Schonfeld et al. | 202/242 |
| 7,108,768 | B2 * | 9/2006 | Oder et al. | 202/242 |
| 7,169,266 | B2 * | 1/2007 | Antalffy et al. | 202/239 |
| 7,357,848 | B2 * | 4/2008 | Lah | 202/242 |

* cited by examiner

*Primary Examiner*—N. Bhat
(74) *Attorney, Agent, or Firm*—Fish & Associates, PC

(57) ABSTRACT

A deheader valve is fitted onto an existing or new coke drum by initially positioning the body and valve, and then raising the valve to mate with the flange using a lifting device other than a chain fall. The vertical positioning of the deheader valve is preferably accomplished with a hydraulic or pneumatic piston, winch, scissor jack, ratchet jack, screw jack, and so forth. The distance traveled by the valve using these devices is more than 2 cm, commonly at least 20 cm, and in some installations up to 40 cm or more. In retrofit situations an oil inlet is provided in a side wall of the drum above the bottom drum flange.

17 Claims, 1 Drawing Sheet

FIG. 1
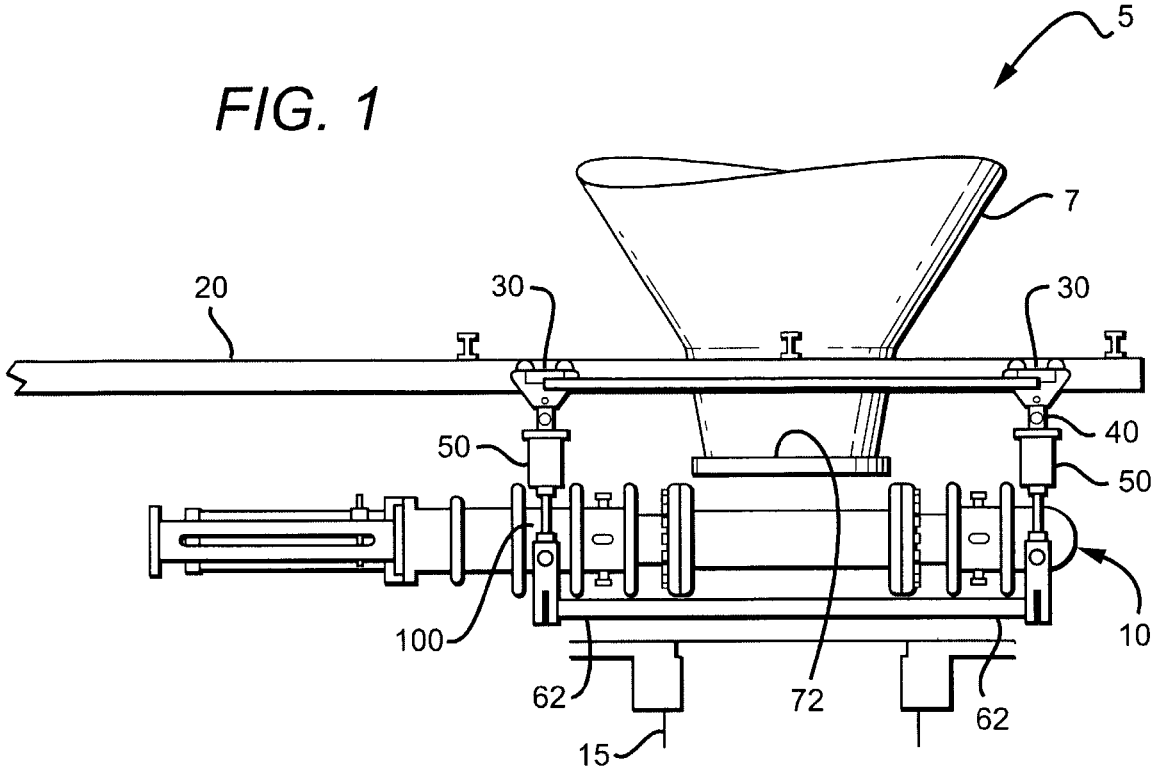
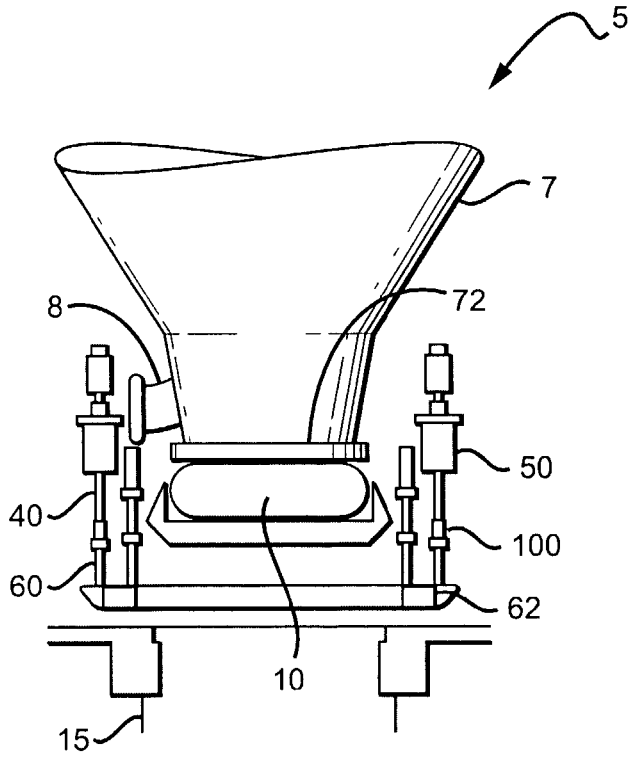
FIG. 2

VALVE INSTALLATION APPARATUS AND METHODS

This application is a national phase filing of our International application with the serial number PCT/US04/08350, which was filed Mar. 17, 2004.

FIELD OF THE INVENTION

The field of the invention is delayed coking.

BACKGROUND

Petroleum refineries often produce valuable distillates and coke by heating residual oil in coking drums. The process, known as delaying coking, involves severe operating conditions with high operating temperatures.

Coke drums are typically large, cylindrical vessels having a top head and a frustoconical bottom portion fitted with a bottom head. Coke drums are usually present in pairs so that they can be operated alternately. Thus, while one coke drum is being filled with residual oil and heated, the other drum is being cooled and purged of up to several hundred tons of coke formed during the previous recovery cycle.

Purging a drum of coke is sometimes referred to as "coke recovery". In the prior art this often involved unbolting and removing the bottom head of the coke drum, and lowering it onto a cart for movement away from the path of the coke. In the more recent prior art pivots have been used to hydraulically move the coke drum head out of the way. Examples of such systems are described in U.S. Pat. No. 5,785,843 to Antalffy et al. (July 1998) and U.S. Pat. No. 6,264,829 to Antalffy et al. (July 2001). These and all other cited materials are incorporated herein by reference.

Still more recent art uses valves, referred to in the industry by the name deheader valves. Instead of unbolting the bottom coke drum head and either transporting or pivoting it out of the way to release the coke, the drum head is permanently replaced with a valve. U.S. Pat. No. 6,565,714 to Lah (May 2003) teaches that the valve can be coupled to the flanged portion of the coke drum. But that teaching does not address installation of the valve. There is no teaching or suggestion in that patent of how this could be done in a new or retrofit situation.

In retrofitting existing installations to use the new valves, problems arise with respect to installing the valves. One problem is that in installations designed for repeated bottom head removal, the bottom of the coke drum is positioned at some distance off the floor to allow for removal or swinging away of the bottom head. When the bottom head is replaced by a deheader valve, there remains a distance between the outlet of the valve and the floor that must be bridged in some manner. Another problem is that the outlet of existing coke drums is often larger than the inlet of the deheader valve (usually 72" diameter vs. 60" diameter). Still another problem is that the oil inlet in existing coke drums is usually located at a bottom blind flange. Elimination of that flange and installation of a deheader valve therefore necessitates providing another oil inlet to the coke drum.

The industry has solved all of these problems simultaneously by inserting a spool piece between the bottom outlet of the coke drum and the top inlet of the deheader valve. The spool piece serves to lower the height of the valve, thereby bridging most of the distance between the valve and the floor. The spool piece is also usually funnel shaped, adapting the larger drum outlet to the smaller valve inlet. Still further, the spool piece is provided with an oil inlet, thus replacing the oil inlet removed from the bottom blind flange.

Installation of a deheader valve using a spool piece is conceptually straightforward. The bottom drum head is removed, the spool piece is installed on the valve, and then the valve with spool piece is moved horizontally into position, and then raised so that it can be bolted onto the bottom of the coke drum. Since deheader valves typically weigh 35 tonnes, the floor of the installation usually cannot support the weight during installation and the valve is instead moved into position using a monorail or other overhead track.

In the prior art the distance that the valve and spool piece must be raised is always quite small, less than 2 cm. This is because the valve with spool piece is positioned under the drum with very little distance between the top of the spool piece and the drum flange. Raising the deheader valve this very small distance can be accomplished using spring hangers (spring cans). Indeed, in all installations of which we are aware, the deheader valve is raised using spring hangers. Although they have a limited range of motion, and move the valve quite slowly, spring hangers are also accurately controllable and well suited to the task.

Recently, the present inventors realized that it may be desirable to fit a deheader valve onto a coke drum without using a spool piece. In that instance, however, some other means must be adopted to provide an oil inlet for the drum, and some other means must be provided for raising the valve into place. Thus, there is still a need to resolve those problems.

SUMMARY OF THE INVENTION

The present invention provides systems and methods for facilitating the fitting of coke drums with deheader valves, by initially positioning the body and valve, and then raising the valve to mate with the flange using a lifting device other than a chain fall.

Instead of using a chain fall, the vertical positioning of the deheader valve is preferably accomplished with a hydraulic or pneumatic piston, winch, scissor jack, ratchet jack, screw jack, and so forth. The distance traveled by the valve using these devices is more than 2 cm, commonly at least 20 cm, and in some installations up to 40 cm or more. All ranges set forth herein are deemed to be inclusive of the endpoints unless the context requires a different interpretation.

In retrofit situations there must also be a provision for an oil inlet to the body of the drum, and that can be readily accomplished by locating an appropriately sized nozzle in the side wall of the drum above the bottom drum flange.

Various objects, features, aspects, and advantages of the present invention will become more apparent from the following detailed description of preferred embodiments of the invention, along with the accompanying drawings in which like numerals represent like components.

BRIEF DESCRIPTION OF THE DRAWINGS

FIG. 1 is a side view of a valve positioning system according to the present invention.

FIG. 2 is an end view of the valve positioning system of FIG. 1.

DETAILED DESCRIPTION

In FIGS. 1 and 2, system 5 generally depicts a coke drum 7 with bottom head having been removed (not shown), valve assembly 10 with an associated discharge chute 15, and supporting equipment, track 20, trolley 30, connecting hardware 40, and a plurality of spring hangers 50. The trolley 30 provides horizontal positioning, and the spring hangers 50 provide vertical support. Additionally, however, the valve assembly 10 and discharge chute 15 are supported by a frame 62, upon which are mounted pistons 100 that provide vertical movement of the valve assembly 10.

The inventive system 5 can utilize any suitable valve assembly 10. Details of suitable valves are known to the industry, with early designs taught in the Lah patent discussed above, U.S. Pat. No. 6,565,714. The valve assembly 10 can be attached to the bottom flange 72 of the coke drum 70 using bolts as in the prior art, or in any other practical manner. The term "valve assembly" is used herein to include the valve itself, and any related parts that are hoisted into place under the drum assembly. In some instances the valve assembly may be nothing more than the valve itself.

Discharge chute 15 is certainly desirable, but optional. In alternative embodiments the coke could pass through the valve across an empty space to a coke chute below (not shown), or a coke chute (not shown) could be raised to the valve in a manner analogous to raising of a coke chute to a bottom flange as in U.S. Pat. No. 5,628,603 to Antalffy et al. (May 1997).

Although all suitable embodiments of the track 20, trolley 30, connecting hardware 40, spring hangers 50, and frame 62 are contemplated, FIG. 2 depicts the most preferred embodiment in which one spring hanger 50 is disposed on each of the four connecting hardware 40. The currently preferred spring hangers 50 are commonly available in the industry and are sized based on the load. Spring hangers 50 can be manually operated individually or in unison to achieve minimal vertical adjustment.

It should be appreciated that the terms "horizontal" and "vertical" are used herein with respect to the ground. It should also be appreciated that references to vertical and horizontal movement refer to the vertical and horizontal aspects of movement. Thus, the valve assembly 10 can be moved horizontally at the same time as it is being moved vertically, and under the definitions herein there is still horizontal and vertical movement even though the combined movements form a curved path.

There are also typically four spaced apart pistons 100, positioned "in-line" with the connecting hardware 40 and the spring hangers 50. (Here again, only two of the pistons are shown in the drawing due to the side elevation). These pistons 100 are capable of raising or lowering the valve assembly 10 at a controlled speed in order to maintain stud alignment within the holes of the coke drum bottom flange. The pistons can be controlled individually or in unison. The pistons need not be positioned as shown. It is possible for example to utilize a frame 62 with a ceiling and a floor, where the ceiling directly supports the valve assembly and/or discharge chute, the floor is dependent from the cables, and one more pistons are positioned between the ceiling and the floor. In other alternative embodiments the pistons could be positioned nearer the trolley, above the spring hangers.

Pistons 100 are merely examples of vertical positioning devices other than a chain fall. Any suitable devices can be used, including hydraulic and pneumatic pistons, winches, scissor jacks, ratchet jacks, screw jacks and the like, all of which can be driven by any suitable means including manual power, electric motors, hydraulic fluid power, pneumatic power. Thus, for example, it is contemplated to utilize a motorized drum near the trolley, along with pulleys as the vertical positioning devices. The inventive concept is to utilize a combination of distinct horizontal and vertical positioning devices which support the valve during operation.

Still other embodiments are contemplated besides those discussed above. For example, instead of a trolley with dependent hardware and frame, it is possible to carry the valve assembly (and optional discharge chute) on a cart (not shown) resting on the floor (not shown). A vertical positioning device (s) can then be utilized to raise the valve assembly (and optional discharge chute) to mate with the drum bottom flange.

Once in place, the valve assembly 10 is bolted directly onto the bottom of the coke drum 7. By this it is meant the valve assembly 10 may be bolted directly to the bottom flange of the drum 7. But there is no spool piece. The spool piece is obviated because the bottom outlet of the coke drum is substantially the same diameter as the inlet of the valve assembly 10, and an oil inlet 8 has been installed in the side of the coke drum 7. This configuration can be supplied on a new drum, or an existing drum can be retrofitted in a corresponding manner.

Thus, specific embodiments and applications have been disclosed for installing deheader valves. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A method of installing a deheader valve on a coke drum, wherein the coke drum has a body portion and a bottom outlet flange, and wherein the deheader valve has an inlet opening in an inlet opening section that is coupled to the valve by a first and a second valve flange, comprising;

horizontally moving the body and the valve to so initially position the body and valve such that the inlet opening is positioned below the outlet flange at a vertical distance greater than a vertical height of at least one of the first valve flange and second valve flange; and then raising the entire valve to allow mating of the inlet opening with the flange using a lifting device other than a chain fall.

2. The method of claim 1, further comprising installing both the coke drum and the valve as part of a new installation.

3. The method of claim 1, further comprising installing the valve to an existing coke drum as part of a retrofit installation.

4. The method of claim 1, where the lifting device comprises a piston.

5. The method of claim 4, wherein the lifting device apparatus comprises a hydraulic piston.

6. The method of claim 4, wherein the lifting device apparatus comprises a pneumatic piston.

7. The method of claim 1, wherein the lifting device comprises a winch.

8. The method of claim 1, wherein the lifting device comprises a scissors.

9. The method of claim 1, wherein the lifting device comprises a screw jack.

10. The method of claim 1, wherein the lifting device raising the valve at least 2 cm.

11. The method of claim 1, wherein the lifting device raising the valve at least 20 cm.

12. The method of claim 1, wherein the lifting device raising the valve at least 40 cm.

13. The method of claim 1, further comprising lifting the valve using a secondary lifting device comprising spring hanger.

14. The method of claim 1, further comprising providing the valve with an inlet having a size that approximates an outlet of the body.

15. The method of claim 14, wherein the lifting device comprises at least one of a piston, winch, scissors, and screw jack, that lifts the valve at least 20 cm.

16. The method of claim 15, further comprising installing both the coke drum and the valve as part of a new installation.

17. The method of claim 1, further comprising installing an oil inlet in a side wall of the drum above the flange.

* * * * *